US009343801B2

(12) United States Patent
Chou et al.

(10) Patent No.: US 9,343,801 B2
(45) Date of Patent: May 17, 2016

(54) ELECTRONIC DEVICE

(71) Applicant: Acer Incorporated, New Taipei (TW)

(72) Inventors: Ming-Yu Chou, New Taipei (TW); Ching-Chi Lin, New Taipei (TW); Kun-Sheng Chang, New Taipei (TW)

(73) Assignee: Acer Incorporated, New Taipei (TW)

( * ) Notice: Subject to any disclaimer, the term of this patent is extended or adjusted under 35 U.S.C. 154(b) by 74 days.

(21) Appl. No.: 14/501,047

(22) Filed: Sep. 30, 2014

(65) Prior Publication Data

US 2016/0028150 A1 Jan. 28, 2016

(30) Foreign Application Priority Data

Jul. 22, 2014 (TW) ..... 103125085 A

(51) Int. Cl.

| | |
|---|---|
| ***H01Q 1/24*** | (2006.01) |
| ***H01Q 1/38*** | (2006.01) |
| ***H01Q 1/48*** | (2006.01) |
| ***H01Q 5/10*** | (2015.01) |

(52) U.S. Cl.

CPC ..... *H01Q 1/243* (2013.01); *H01Q 1/48* (2013.01); *H01Q 5/10* (2015.01)

(58) Field of Classification Search

USPC ..... 343/700 MS, 702

See application file for complete search history.

(56) References Cited

U.S. PATENT DOCUMENTS

| | | | | |
|---|---|---|---|---|
| 2011/0102272 | A1* | 5/2011 | Wong | H01Q 1/243 343/702 |
| 2012/0194390 | A1* | 8/2012 | Endo | H01Q 1/243 343/700 MS |
| 2014/0361930 | A1* | 12/2014 | Liu | H01Q 1/243 343/700 MS |
| 2015/0333390 | A1* | 11/2015 | Peng | H01Q 7/00 343/702 |
| 2015/0380820 | A1* | 12/2015 | Wu | H01Q 5/378 343/702 |

* cited by examiner

*Primary Examiner* — Tan Ho

(74) *Attorney, Agent, or Firm* — Jianq Chyun IP Office

(57) ABSTRACT

An electronic device having a radiation part and a metallic frame is provided. The radiation part is L-shaped, and includes a feeding branch and an open branch. The metallic frame includes a first metallic part and a second metallic part. The first metallic part is L-shaped, wherein a first side of the first metallic part is near the open branch of the radiation part, and a first gap exists therebetween. The second metallic part is L-shaped, wherein an open terminal of a first side of the second metallic part is aligned with an open terminal of the first side of the first metallic part, and a second gap exists therebetween. The radiation part and the metallic frame forms an antenna to transceive a plurality of radio frequency signals.

6 Claims, 3 Drawing Sheets

ELECTRONIC DEVICE

CROSS-REFERENCE TO RELATED APPLICATION

This application claims the priority benefit of Taiwan application serial no. 103125085, filed on Jul. 22, 2014. The entirety of the above-mentioned patent application is hereby incorporated by reference herein and made a part of this specification.

BACKGROUND OF THE INVENTION

1. Field of the Invention

The invention relates to an electronic device, and particularly relates to an electronic device having a metallic frame.

2. Description of Related Art

As science and technology advance, electronic devices such as smart phones and tablet computers are used more broadly in our daily lives. Other than the design tendency of the electronic devices aiming at being light, thin, and compact for meeting the needs to carry around, the sense of quality is also highly valued by users. Thus, more and more designers choose a metallic material when designing the case of a mobile electronic device. However, when a metallic material is chosen in the design of the case, it is difficult not to influence the transceiving performance of the antenna of the electronic device. For example, the plane of the case may cause a shielding effect to the antenna, or the touch by a human body part may results in energy attenuation of the antenna when the metallic case serves as a part of the antenna. Thus, how to maintain the transceiving performance of the antenna while improving the sense of quality at the same time has become an important issue in this field.

SUMMARY OF THE INVENTION

The invention provides an electronic device, where a part of a metallic frame is integrated into a design of an antenna.

An electronic device of the invention includes a radiation part and a metallic frame. The radiation part has an L shape and includes a feeding branch and an open branch, wherein the feeding branch has a feeding terminal and the open branch has an open terminal. The metallic frame includes a first metallic part and a second metallic part. The first metallic part has an L shape and includes a first side and a second side. The first side has an open terminal and the second side has a ground terminal connected to a system ground plane. In addition, the first side of the metallic part is near the open branch of the radiation part and a first gap exists between the first side of the first metallic part and the open branch of the radiation part. The second metallic part has an L shape and includes a first side and a second side. The first side has an open terminal and the second side has a ground terminal connected to the system ground plane. In addition, the open terminal of the first side of the second metallic part is aligned to the open terminal of the first side of the first metallic part, and a second gap exists between the open terminal of the first side of the second metallic part and the first side of the first metallic part. The radiation part and the metallic frame form an antenna for transceiving a plurality of radio frequency signals.

Based on the above, the invention provides an electronic device capable of transceiving a plurality of radio frequency signals at different frequency bands by using a combination of the radiation part and the metallic frame.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
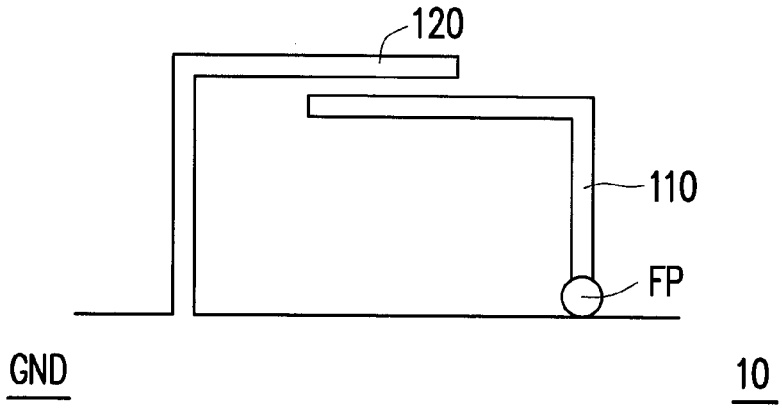
FIG. 1 is a schematic view illustrating an antenna having a monopole antenna coupling structure.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a schematic view illustrating an antenna having a monopole antenna coupling structure. Referring to FIG. 1, an antenna 10 includes an L-shaped radiation part 110 and an L-shaped parasitic part 120. Herein, the antenna 10 may be configured to transceive a first radio frequency signal and a second radio frequency signal. A length of the radiation part 110 may be set to be close to a quarter of a wavelength of the first radio frequency signal, while a length of the parasitic part 120 may be set to be close to a quarter of a wavelength of the second radio frequency signal.

The radiation part 110 may generate a mode to transceive the first radio frequency signal based on an operation principle of the monopole antenna. For example, the first radio frequency signal is fed to the radiation part 110 through a feeding point FP, or the first radio frequency signal is transmitted to the feeding point FP through the radiation part 110). In addition, the antenna 10 may generate another mode to transceive the second radio frequency signal through a resonance by coupling the radiation part 110 with the parasitic part 120. With such configuration, an electronic device where the antenna 10 is configured may transceive the first radio frequency signal and the second radio frequency signal by using the antenna 10. Generally speaking, the permitted length of the parasitic part 120 is longer than the length of the radiation part 110. Thus, the first radio frequency signal may be set as a high frequency signal, while the second radio frequency signal may be set as a low frequency signal (i.e., a frequency signal with central frequency that relatively lower than the central frequency than the first radio frequency).

Figure 2:
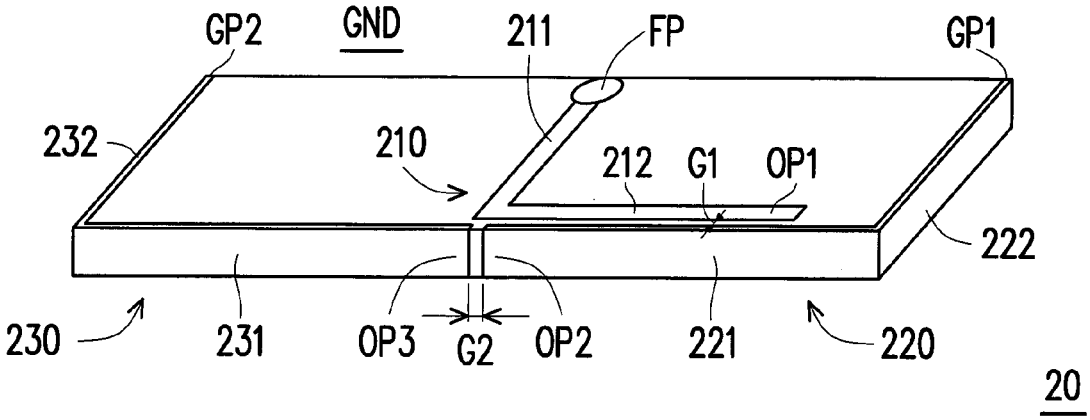
FIG. 2 is a schematic view illustrating an electronic device according to an embodiment of the invention.

FIG. 2 is a schematic view illustrating an electronic device according to an embodiment of the invention. Referring to FIG. 2, an electronic device 20 includes a radiation part 210 and a metallic frame. The radiation part is L-shaped and includes a feeding branch 211 and an open branch 212. In addition, the feeding branch 211 has the feeding terminal FP and the open branch 212 has an open terminal OP1.

The metallic frame includes a first metallic part 220 and a second metallic part 230. The first metallic part 220 is L-shaped and includes a first side 221 and a second side 222. The first side 221 has an open terminal OP2 and the second side 222 has a ground terminal GP1 connected to a system ground plane GND. In addition, the first side 221 of the first metallic part 220 is near the open branch 212 of the radiation part 210, and a first gap G1 exists between the first side 221 of the first metallic part 220 and the open branch 212 of the radiation part 210.

The second metallic part 230 is L-shaped and includes a first side 231 and a second side 232. The first side 231 of the second metallic part 230 has an open terminal OP3 and the second side 232 of the second metallic part 230 has a ground terminal GP2 connected to the system ground plane GND. In addition, the open terminal OP3 of the first side 231 of the second metallic part 230 is aligned to the open terminal OP2 of the first side 221 of the first metallic part 220, and a second gap G2 exists between the open terminal OP3 of the first side 231 of the second metallic part 230 and the open terminal OP2 of the first side 221 of the first metallic part 220.

In this embodiment, the radiation part 211 and the metallic frame (i.e. the first metallic part 220 and the second metallic part 230) form an antenna to transceive a plurality of radio frequency signals at different frequency bands. In fact, similar to the antenna in the embodiment shown in FIG. 1, the radiation part 210 may generate a first mode to transceive the first radio frequency signal based on the operation principle of the monopole antenna (e.g., a length from the feeding terminal FP to the open terminal OP1 is a quarter of the wavelength of the first radio frequency signal). In terms of antenna structure, the first metallic part 220 is equivalent to a parasitic part (similar to the parasitic part 120 shown in FIG. 1) extending from the system ground plane GND. The electronic device 10 may also generate a second mode to transceive the second radio frequency signal through the resonance by coupling the radiation part 110 with the parasitic part 120 (i.e., a length from the open terminal OP2 to the ground terminal GP1 is a quarter of the wavelength of the second radio frequency signal).

The first radio frequency signal or the second radio frequency signal may be transmitted by a signal processing unit (not shown) of the electronic device to the feeding point FP, or the signal processing unit may receive the first radio frequency signal or the second radio frequency signal through the feeding point FP. The signal processing unit of the electronic device 20 may be connected to the feeding point FP through an inner edge of a coaxial cable line, while an outer edge is connected to the system ground plane GND. However, the invention is not limited thereto.

The embodiment shown in FIG. 2 differs from the embodiment shown in FIG. 1 in that the embodiment shown in FIG. 2 further includes the second metallic part 230. In terms of antenna structure, the second metallic part 230 is equivalent to the parasitic part extending from the system ground plane. A length of the second metallic part 230 (i.e., the length from the open terminal OP3 to the ground terminal GP2) may be set to be close to a quarter of a wavelength of a third radio frequency signal. When the third radio frequency signal is transmitted or received through the feeding point FP, the second metallic part 230 may generate a third mode through the resonance by a return current returning from the system ground plane GND. Accordingly, the electronic device 20 may transceive the third radio frequency signal by using the third mode.

Since the second metallic part 230 and the first metallic part 220 are the metallic frame of the electronic device 20, the length of the second metallic part 230 would be close to that of the first metallic part 220. Therefore, the third radio frequency may be a low frequency signal close to a center frequency of the second radio frequency signal. When transceiving a low frequency signal, energy of a return current returning from the system ground plane GND is higher than energy of a return current when transceiving a high frequency signal. Therefore, the third mode generated by the resonance by the return current of the second metallic part 230 generally has a preferable transceiving performance as well.

In this embodiment, the first metallic part 220 and the second metallic part 230 may be a part of a metallic case of the electronic device 20, such as a lower edge of the electronic device 20 or a decorative metallic string of the electronic device 20. In addition, the first metallic part 220 and the second metallic part 230 are disconnected from each other and not electrically conductive. The gap G2 between the first metallic part 220 and the second metallic part 230 may be supported by a non-conductive material such as FR4. Widening the gap G2 may raise up the operating frequencies of the second and third modes, and narrowing the gap G2 may lower the operating frequencies of the second and third modes. The designer of the electronic device 20 may make an adjustment based on actual needs. However, considering the appearance, the gap G2 should not be overly wide. In an embodiment of the invention, the gap G2 is set to be approximately 1.5 mm. However, the invention is not limited thereto.

Figure 3:
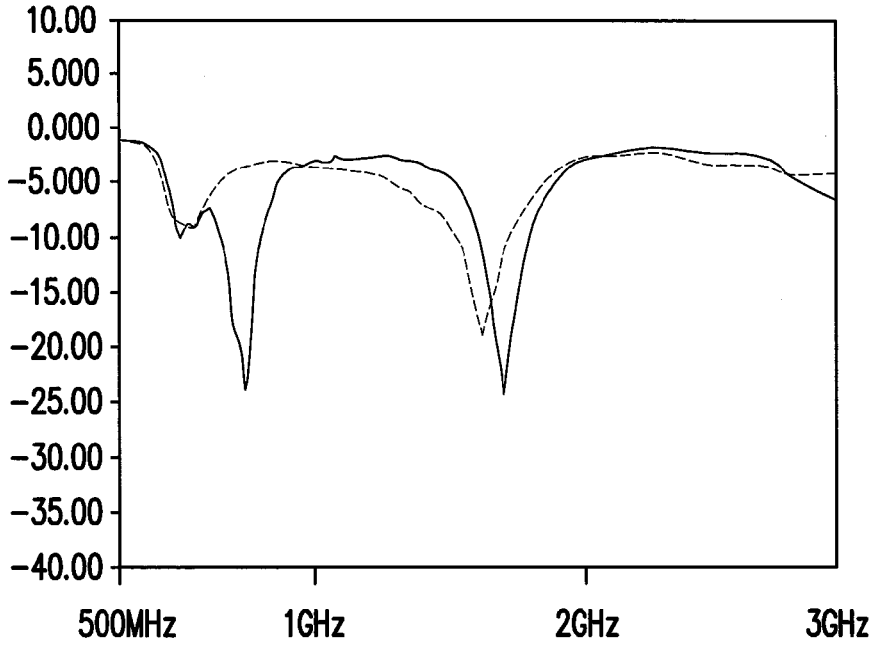
FIG. 3 is a frequency response diagram of the antenna shown in FIG. 1 and an antenna formed by a radiation part and a metallic frame shown in FIG. 2.

FIG. 3 is a frequency response diagram of the antenna 10 shown in FIG. 1 and the antenna formed by the radiation part 210 and a metallic frame shown in FIG. 2. In this embodiment, the lengths of the radiation part 110 shown in FIG. 1 and the radiation part 210 shown in FIG. 2 are set to be close to a quarter of the wavelength of the first radio frequency signal, the lengths of the parasitic part 120 shown in FIG. 1 and the first metallic part 220 shown in FIG. 2 are set to be close to a quarter of the wavelength of the second radio frequency signal, and the length of the second metallic part 230 shown in FIG. 2 is set to be close to a quarter of the wavelength of the second radio frequency signal. In the embodiment shown in FIG. 3, center frequencies of the first radio frequency signal, the second radio frequency signal, and the third radio frequency signal are approximately 1940 MHz, 704 MHz, and 892 MHz respectively.

As shown in FIG. 3, compared with a frequency response (illustrated with a dotted line) of the antenna 10 shown in FIG. 1, a frequency response (illustrated with a solid line) of the antenna formed by the radiation part 210 and the metallic frame in the embodiment shown in FIG. 2 has an additional mode (i.e. the third mode) between 824 MHz to 960 MHz. Moreover, compared with the first mode generated by the radiation part 210 shown in FIG. 2 and the second mode generated through resonance of the radiation part 210 and the first metallic part 220 shown in FIG. 2, the third mode has a comparable performance to that of the first and second modes. The third mode even has a better performance than the performance of the second mode.

As shown above, the metallic frame (the first metallic part 220 and the second metallic part 230) is equivalent to the length of the electronic device 20 and corresponds to a size of the electronic device 20. However, there may be multiple factors to consider when it comes to the size of the electronic device 20, so the size may not correspond to the wavelength of the radio frequency signal to be transceived. In the invention, the designer of the electronic device may adjust the operation frequency thereof by changing lengths of current paths on the first metallic part 220 and the second metallic part 230. In a preferred situation, the modes that may be generated by the first metallic part 220 and the second metallic part 230 operation frequencies that are substantially close to the center frequencies of the second radio frequency signal and the third radio frequency signal.

Figure 4:
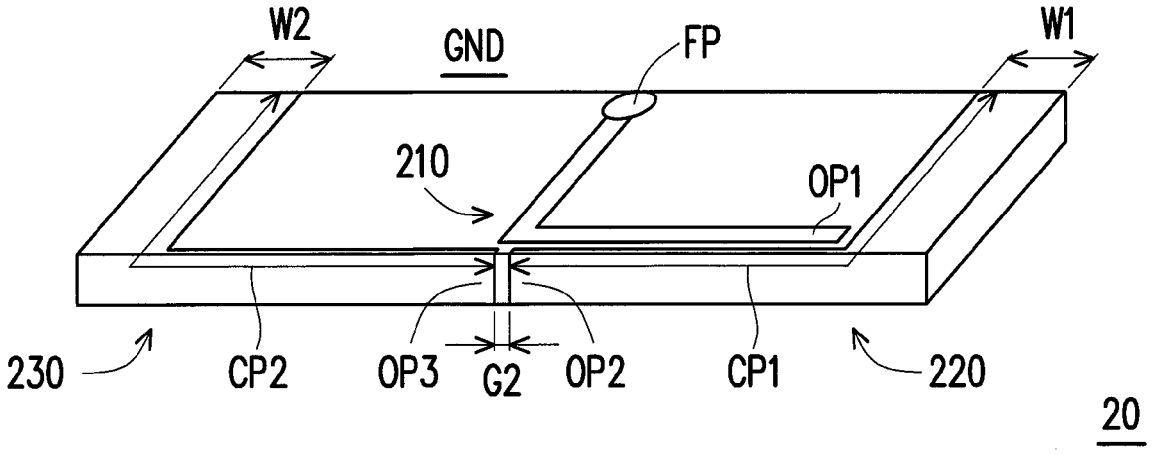
FIGS. 4 to 6 are schematic views illustrating electronic devices according to embodiments of the invention.

FIG. 4 is a schematic view illustrating an electronic device according to an embodiment of the invention. Referring to FIG. 4, in this embodiment, widths (i.e. widths W1 and W2) of the second side 222 of the first metallic part 220 and the second side 232 of the second metallic part 230 are widened. In a transceiving process of the antenna, a current and energy generated during transceiving of radio frequency signals are transmitted along a shortest path (i.e. along inner sides of the second side 222 of the first metallic part 220 and the second side 232 of the second metallic part 230), and the lengths of the current paths on the first metallic part 220 and the second metallic part 230 may thus be reduced with such setting. The designer of the electronic device may make lengths of the current path CP1 and CP2 respectively close to a quarter of the wavelength of the second and a quarter of the wavelength of the third radio frequency signals respectively by adjusting the widths W1 and W2.

When the designer of the electronic device intends to increase the widths (i.e. the widths W1 and W2) of the second side 222 of the first metallic part 220 and the second side 232 of the second metallic part 230, it does not need to substantially increase a thickness of metal on the second side 222 of the first metallic part 220 and the second side 232 of the second metallic part 230, but only requires to pave a conductive metal layer connected to the second side 222 of the first metallic part 220 and the second side 232 of the second metallic part 230 on the substrate (formed of the non-conductive FR4 material, for example) between the second side 222 of the first metallic part 220, the second side 232 of the second metallic part 230, and the radiation part 210.

Besides, according to FIG. 2, the open branch 212 of the radiation part 210 and the first side 221 of the first metallic part 220 are parallel and the gap G1 therebetween is narrow. Such structure may result in an overly intensive coupling energy between the radiation part 210 and the first side 221 of first metallic part 220, making the operation frequency shifted when the radiation part 210 is used to transceive the first radio frequency signal (i.e. the operation frequency is lowered and becomes inconsistent with the center frequency of the first radio frequency signal) or even causing an issue of low antenna efficiency. Regarding this issue, the shifted frequency may be improved by adjusting the length of the radiation part 210, and the overly intense coupling energy may be weakened by adjusting the gap G1.

Figure 5:
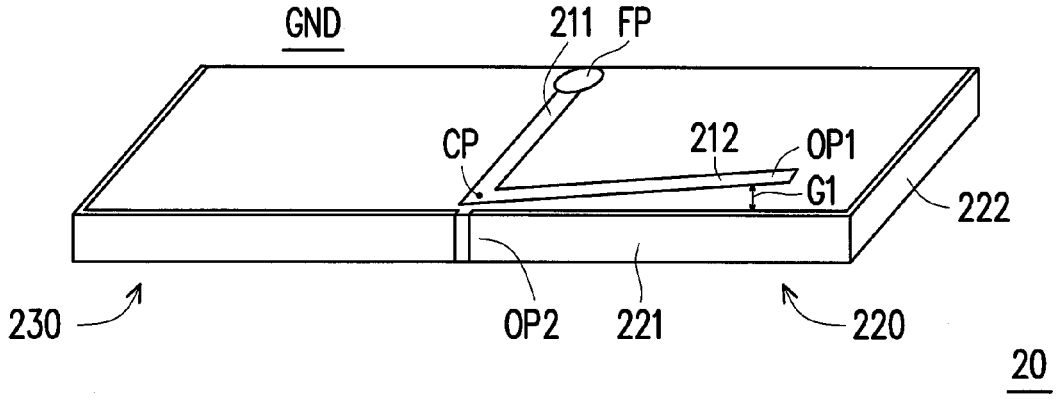

FIG. 5 is a schematic view illustrating an electronic device according to an embodiment of the invention. The embodiment shown in FIG. 5 differs from the embodiment shown in FIG. 2 in that in this embodiment; the open branch 212 of the radiation part 210 is not parallel to the first side 221 of the first metallic part 220. In this embodiment, an included angle between the feeding branch 211 and the open branch 212 of the radiation part 210 is set to be less than 90 degrees, such that a width of the gap G1 gradually increases from a connection point CP (i.e. a position where the feeding branch 211 and the open branch 212 are connected) to the open terminal OP1 of the radiation part 210.

Through the change of the width of the gap G1, the coupling energy between the radiation part 210 and the first metallic part 221 may be reduced. Therefore, the electronic device 20 may still maintain a preferable antenna frequency when transceiving the first radio frequency signal.

Figure 6:
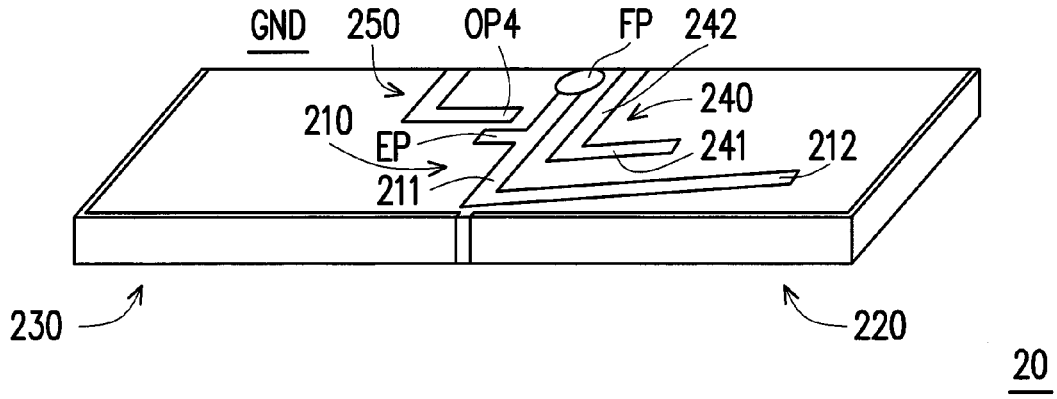

In this embodiment, other parasitic elements may be disposed around the radiation part 210, so that the same structure (e.g. the antenna structure formed by the radiation part and the metallic frame as shown in FIGS. 2, 4, and 5) may be used to transceive more radio frequency signals at different frequency bands. FIG. 6 is a schematic view illustrating an electronic device according to an embodiment of the invention. Referring to FIG. 6, compared with the embodiment shown in FIG. 5, the electronic device 20 shown in FIG. 6 further includes parasitic parts 240 and 250 and a subsidiary extension part EP. The parasitic part 240 is substantially L-shaped and has a first side 241 and a second side 242. In addition, a first branch 241 of the parasitic part 240 is near and parallel to the open branch 212 of the radiation part 210. A second branch 242 of the parasitic part 240 is near the feeding branch 211 of the radiation part 210. In addition, the first branch 241 of the parasitic part 240 may not be parallel to the open branch 212 of the radiation part 210, depending on whether the coupling energy in the actual practice influences the antenna efficiency. The subsidiary extension part EP extends in a direction from the feeding branch 211 of the radiation part 210 toward the opposite of the open terminal OP1 of the radiation part 210. In addition, a length of the subsidiary extension part EP is significantly shorter than the open branch 212 of the radiation part 210. The parasitic part 250 is also L-shaped, extends from the system ground plane GND, and has an open terminal OP4. In addition, the open terminal OP4 is near the feeding branch 211 of the radiation part 210 and the subsidiary extension part EP.

In this embodiment, lengths of the subsidiary parts 240 and 250 are respectively set to be close to a quarter of a wavelength of a fourth radio frequency signal and a quarter of a wavelength of a fifth radio frequency signal. By configuring the parasitic parts 240 and 250, the electronic device 20 may generate a fourth mode and a fifth mode by coupling the radiation part 210 with the parasitic parts 240 and 250 respectively to transceive the fourth and fifth radio frequency signals. In addition, it can be told by the structure of the electronic device 20 that the lengths of the parasitic parts 240 and 250 are shorter than the length of the radiation part 210. Therefore, the fourth and fifth radio frequency signals are high frequency signals having center frequencies higher than the first radio frequency signal.

For example, in an embodiment of the invention, the center frequencies of the fourth and fifth radio frequency signals are respectively 2.17 GHz and 2.6 GHz. With the configuration of the embodiment shown in FIG. 3 (i.e. the center frequencies of the first, second, and third radio frequency signals are approximately 1940 MHz, 704 MHz, and 892 MHz respectively), the electronic device 20 may use the plurality of modes generated by using the radiation part, the metallic frame (the first metallic part 220 and the second metallic part 230), and the parasitic parts 240 and 250 to transceive radio frequency signals covering frequency bands of the second generation mobile communication, the third generation mobile communication, and the fourth generation mobile communication, such as frequency bands of the global system for mobile communication (GSM) at 850 MHz, 900 MHz, 1800 MHz, and 1900 MHz, the first frequency band of the wideband code division multiple access (WCDMA) agreement, and frequency bands of B7, B13, B17, and B20 of the long term evolution (LTE) technology agreement.

In view of the foregoing, the invention provides an electronic device that forms the antenna by coupling the radiation part with the metallic frame of the electronic device and is capable of performing full-band operation of the second generation mobile communication, the third generation mobile communication, and the fourth generation mobile communication by using the antenna. In addition, as proven by experiments, the antenna formed by coupling the radiation part with the metallic part disclosed in the invention also presents a preferable hand-held antenna performance. Even if the metallic frame is touched by the user, the efficiency of the antenna is still maintained at a preferable state.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a radiation part, having an L shape and comprising a feeding branch and an open branch, wherein the feeding branch has a feeding terminal and the open branch has an open terminal; and a metallic frame, comprising:

a first metallic part, having an L shape and comprising a first side and a second side, the first side having an open terminal and the second side having a ground terminal connected to a system ground plane, wherein the first side is near the open branch of the radiation part and a first gap exists between the first side and the open branch of the radiation part; and a second metallic part, having an L shape and comprising a first side and a second side, the first side having an open terminal and the second side having a ground terminal connected to the system ground plane, wherein the open terminal of the first side of the second metallic part is aligned to the open terminal of the first side of the first metallic part, and a second gap exists between the open terminal of the first side of the second metallic part and the first side of the first metallic part, wherein the radiation part and the metallic frame form an antenna for transceiving a plurality of radio frequency signals.

2. The electronic device as claimed in claim 1, wherein:

the radio frequency signals comprises a first radio frequency signal, a second radio frequency signal, and a third radio frequency signal, wherein central frequencies of the first radio frequency signal, the second radio frequency signal, and the third radio frequency signal are respectively at a first high frequency, a first low frequency, and a second low frequency;

a length from the feeding terminal to the open terminal of the radiation part is a quarter of a wavelength of the first radio frequency signal;

a length from the open terminal to the ground terminal of the first metallic part is close to a quarter of a wavelength of the second radio frequency signal; and a length from the open terminal to the ground terminal of the second metallic part is close to a quarter of a wavelength of the third radio frequency signal.

3. The electronic device as claimed in claim 2, wherein:

a width of the first side of the first metallic part is greater than a width of the second side of the first metallic part, and a shortest distance from the open terminal of the first metallic part to the system ground plane is close to a quarter of the wavelength of the second radio frequency signal; and a width of the first side of the second metallic part is greater than a width of the second side of the second metallic part, and a shortest distance from the open terminal of the second metallic part to the system ground plane is close to a quarter of the wavelength of the third radio frequency signal.

4. The electronic device as claimed in claim 1, wherein:

the feeding branch and the open branch of the radiation part are connected at a connection point; and a width of the first gap between the connection point of the radiation part and the first side of the first metallic part is different from a width of the first gap between the open terminal of the radiation part and the first side of the metallic part.

5. The electronic device as claimed in claim 1, wherein:

the radio frequency signals further comprises a fourth radio frequency signal, wherein a center frequency of the fourth radio frequency signal is at a second high frequency; and the electronic device further comprises:

a first parasitic part, having an L shape and having a first branch and a second branch, wherein the first branch of the first parasitic part is near and parallel to the open branch of the radiation part, the second branch of the first parasitic part is near the feeding branch of the radiation part, and a length of the first parasitic part is a quarter of a wavelength of the fourth radio frequency signal.

6. The electronic device as claimed in claim 1, wherein:

the radio frequency signals further comprises a fifth radio frequency signal, wherein a center frequency of the fifth radio frequency signal is at a third high frequency; and the electronic device further comprises:

a subsidiary extension part, extending in a direction from the feeding branch of the radiation part toward the opposite of the open terminal of the radiation part, wherein a length of the subsidiary extension part is significantly shorter than that of the open branch of the radiation part; and a second parasitic part, having an L shape, extending from the system ground plane, and having an open terminal, wherein the open terminal is near the feeding branch of the radiation part and the subsidiary extension part, and a length of the second parasitic part is a quarter of a wavelength of the fifth radio frequency signal.

* * * * *